United States Patent [19]

Seiden et al.

[11] 4,158,472

[45] Jun. 19, 1979

[54] PATCH MODULE

[75] Inventors: Lewis J. Seiden, Tappan, N.Y.; Joseph P. Magnano, Norwalk, Conn.

[73] Assignee: T-Bar, Incorporated, Wilton, Conn.

[21] Appl. No.: 894,104

[22] Filed: Apr. 6, 1978

Related U.S. Application Data

[62] Division of Ser. No. 810,923, Jun. 29, 1977.

[51] Int. Cl.[2] ..... H01R 11/18

[52] U.S. Cl. ..... 339/19; 339/29 R; 339/183

[58] Field of Search ..... 339/19, 28, 29, 176 P, 339/182, 183

[56] References Cited

U.S. PATENT DOCUMENTS

| | | | |
|---|---|---|---|
| 3,001,167 | 9/1961 | Chesnutt et al. | 339/183 |
| 3,158,422 | 11/1964 | Bowden et al. | 339/183 |
| 3,222,471 | 12/1965 | Steinkamp | 339/183 |

*Primary Examiner*—Joseph H. McGlynn

*Attorney, Agent, or Firm*—Dann, Dorfman, Herrell and Skillman

[57] ABSTRACT

A patch module assembly consists of a two piece frame structure, which provides three parallel jack receptacles entering the frame through one end for receiving patch cord wand. The sides of the frame are closed by printed circuit boards which are electrically connected through plug connectors through the other end wall. The circuit boards support T-Bar ® type switch wafers whose normally closed switches are in series in the various printed circuits between connectors. The printed circuitry also connects spring contacts at one of the wand support receptacles to one side of one of the switches. Another wand support receptacle has spring contacts connected to the opposite side of the switches. A third wand support receptacle has spring contacts connected to either one side or the other of the switches. The contacts of the respective receptacles mate with contacts on an insertable wand, which enable patch connection to other circuits. Placing the wand in the first or second receptacle causes an actuator to disconnect the series switches after which one side or the other of each series switch is connected to some remote circuit. The third receptacle does not disconnect the series switches but makes a connection to the line through each series switch to serve as a voltage monitoring device, or the like. In the first two receptacles, the nose of the wand engages a different cam surface of the same actuation lever, which moves against an actuation plunger of the series switch wafer opening the normally closed contacts. The wand is a split cylindrical structure of hollow form, internal portions of which provide two oppositely directed contact assemblies. The contact assemblies can be preassembled and prewired before assembling the wands. In the assembly of the two halves of the cylindrical wand, insulator bases opposed to each other urge the contacts outwardly through holes along diametrically opposite sides of the wand positioned to engage the respective spring fingers.

7 Claims, 12 Drawing Figures

40'
108
96a
96b
96c
96d
96e
96f
96g
96h
96i
96j
96k
96m
96a'
96b'
96c'
96d'
96e'
96f'
96g'
96h'
96i'
96j'
96k'
96m'
7
40e
40d
40c
40
112
40a
116
124
120
114
122
130
114'
96h
96h'
106a
80B
100B
106b
96'
96
42
100A
80A

PATCH MODULE

This is a division, of application Ser. No. 810,923 filed June 29, 1977.

The present invention provides a path module for making substitute patch electrical connections temporarily or permanently into established circuits, with or without interrupting previous circuit connections. More specifically, the present invention concerns a mechanical frame structure providing wand support receptacles having spring contacts to which contacts on the wands can be connected upon insertion and proper positioning of a wand into a wand support receptacle permitting the patch to be completed. In some receptacles, separate switches are also opened to isolate previously connected circuits. The frame and housing assembly and the wand construction in accordance with the present invention are novel.

In the prior art it has been the practice to provide patches which can commonly be handled on a one-to-one basis. That is, a circuit is interrupted and a new circuit is patched to one side of the interrupted circuit or the other using jack plugs and switch boards, patch boards, or other well known devices.

In more recent years, multiple circuit patching has become possible and commercially two devices have been generally available. One, made by Cooke Engineering, provides an insertable plug or wand which carries contact pins each of which, upon rotation of the wand in its jack socket, provides the mechanical means to move one contact away from another to interrupt a circuit which is normally closed and at the same time provides an electrical contact which makes contact with the switch contact it is moving and connects a new circuit to that contact. This structure is shown in U.S. Pat. No. 3,665,129.

Another entirely different type of multiple circuit patching device made by Atlantic Research consists of a rectangular cross-sectional type wand which provides contacts which are spread across one flat face and make sliding engagement with strip contacts on a flat surface as the wand is inserted. The strip contacts on the frame are parallel columns of printed circuit, material which may provide continuous or intermittent contact with the strips.

The present invention has certain structural similarity and appearance in common with Cooke's structure but operates quite differently and constitutes a much improved structure with completely separate switching functions.

The present construction permits separate switches related to the same circuit to operate in sequence, preferably first interrupting a circuit and then patching in a new circuit. Because the switches are completely electrically isolated from one another, the structure of the present invention avoids ambiguities and problems in troubleshooting. Furthermore, the opening of one set of the switches and the closing of another are positively determined by separable actions at successive stages, and one does not have to worry about accomplishing two functions with the same set of contacts, or making double use of at least one contact of a pair.

The present invention provides a simple modular construction in which each patch unit is based upon a frame construction wherein the frame, preferably of lightweight material, extends around the narrow dimension of the outside of the entire structure. This frame may be made of molded resinous material or other appropriate material. Reinforcing ribs and other structural pieces of the structure such as members defining the jack receptacles and spring supports may also be molded as an integral part of the frame pieces. A simple molded lever actuator and pivot pins may be separately molded. The lever actuator and its associated spring may then be assembled between frames pieces and the sides of the frame closed and held together with common fasteners preferably using fiberglass printed circuit boards. In preferred embodiments, three jack receptacles extend through an end wall of the frame and parallel to each other and to the frame walls defining the length of the structure. In preferred embodiments, the printed circuits simply provide continuation of other circuitry extending outside the module and brought in by suitable electrical connectors in the end wall opposite that of the jack receptacles. Ordinarily, normally closed series switches connected to the printed circuits are provided by wafer switch modules, preferably of the switches of a common actuatable type shown in U.S. Pat. No. 3,233,541 assigned to the assignee of this application. The terminals at opposite ends of such switch modules are plugged into the circuit board and soldered in place to the printed circuits conductors through which they pass. Other circuits are patched into various printed circuits through the wand contacts which, in the preferred embodiments, connect with spring finger contacts electrically connected to separate circuits, supported on the printed circuit boards, and positioned to be contacted by the contacts on the wands as they are rotated into operative position.

The wands themselves in accordance with the present invention, are a novel construction of generally hollow tubular form preferably using rigid molded resinous material. The wand is split and mechanically held together. Before assembly, the two halves provide easily assembled structures wherein contact assemblies may be prewired allowing the conductors to be collected in a cable passing out the end extending out of the wand. The contact assemblies include insulator support members which support the contacts such that they are insulated from one another and properly indexed with respect to their holes through the wand. The contact supports are opposed to one another and hold each other and their supported contacts in indexed positions when the two wand pieces are assembled together. The contacts extend out of openings aligned along the cylindrical walls on diametrically opposite sides to cooperate with spring fingers on opposite sides of the receiving jack receptacles.

For a better understanding of the present invention, reference is made to the drawings in which.

Figures 4A, 4B, 6A, 6B, 6C, 7:
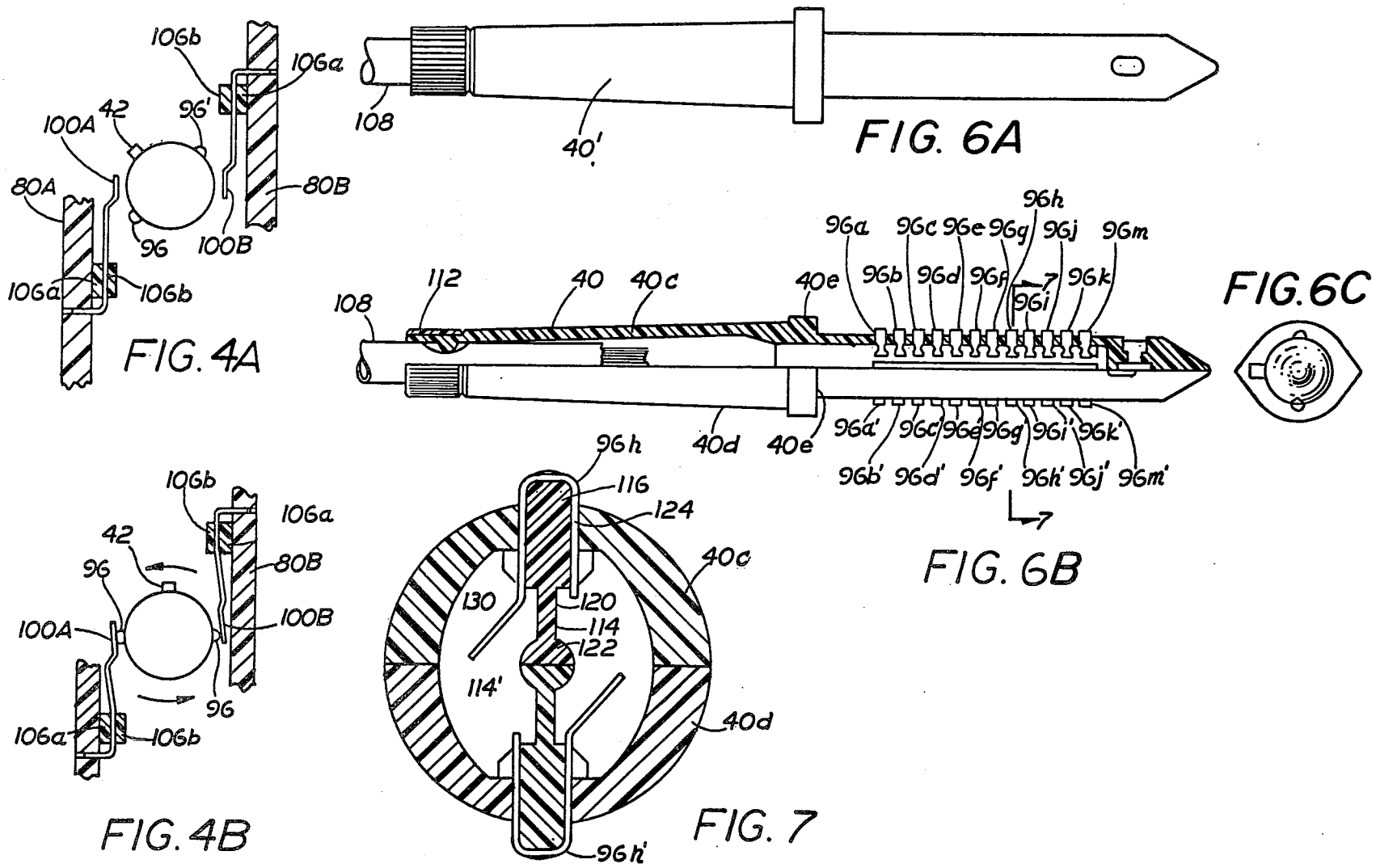
Figure 5:
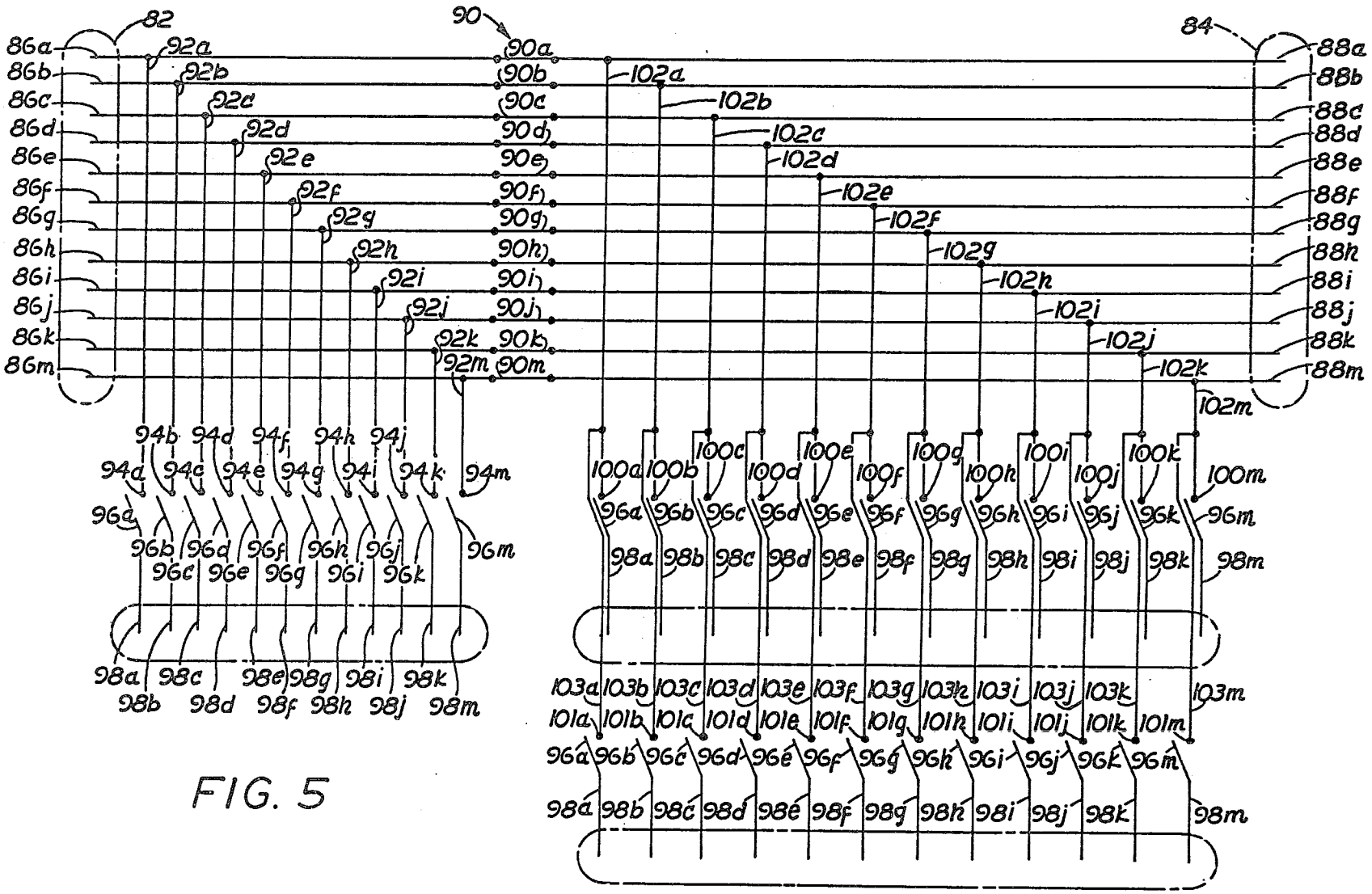
Figure 9:
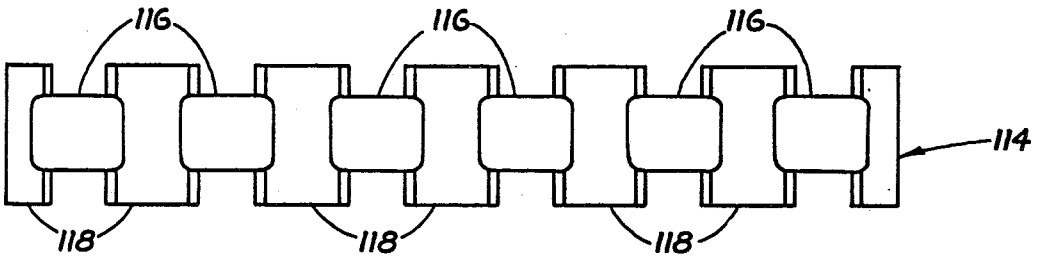
Figure 8:
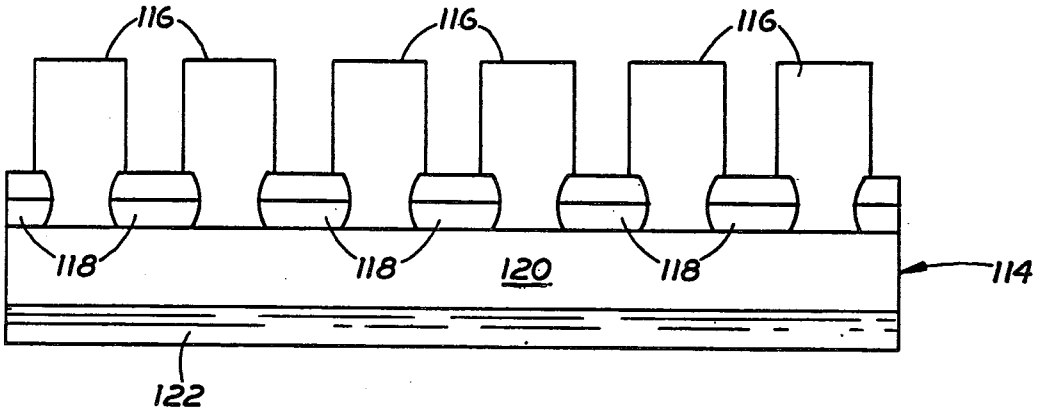

FIG. 4*a* is a schematic cross-sectional view of the wand at the contact level fully inserted into the jack receptacle but before rotation so that its contacts make contact with spring fingers;

FIG. 4*b* is a view similar to FIG. 4*a* showing the wand after rotation so that its contacts are in contact with the spring fingers;

FIG. 5 is a schematic electrical diagram showing the circuitry for the printed circuit board and the cooperating half of the wand;

FIG. 6A is a partially schematic representation of a a terminating wands;

FIG. 6B is a similar showing of one of the wands in a quarter section;

FIG. 6C is an end view of the wands of FIGS. 6A and 6B;

FIG. 7 is a sectional view taken along section line 7—7 of FIG. 6B;

FIG. 8 is a side elevational view of a portion of the insulating block for supporting contacts for one side of a wand; and FIG. 9 is a plan view of the same structure as FIG. 8.

Figure 1:
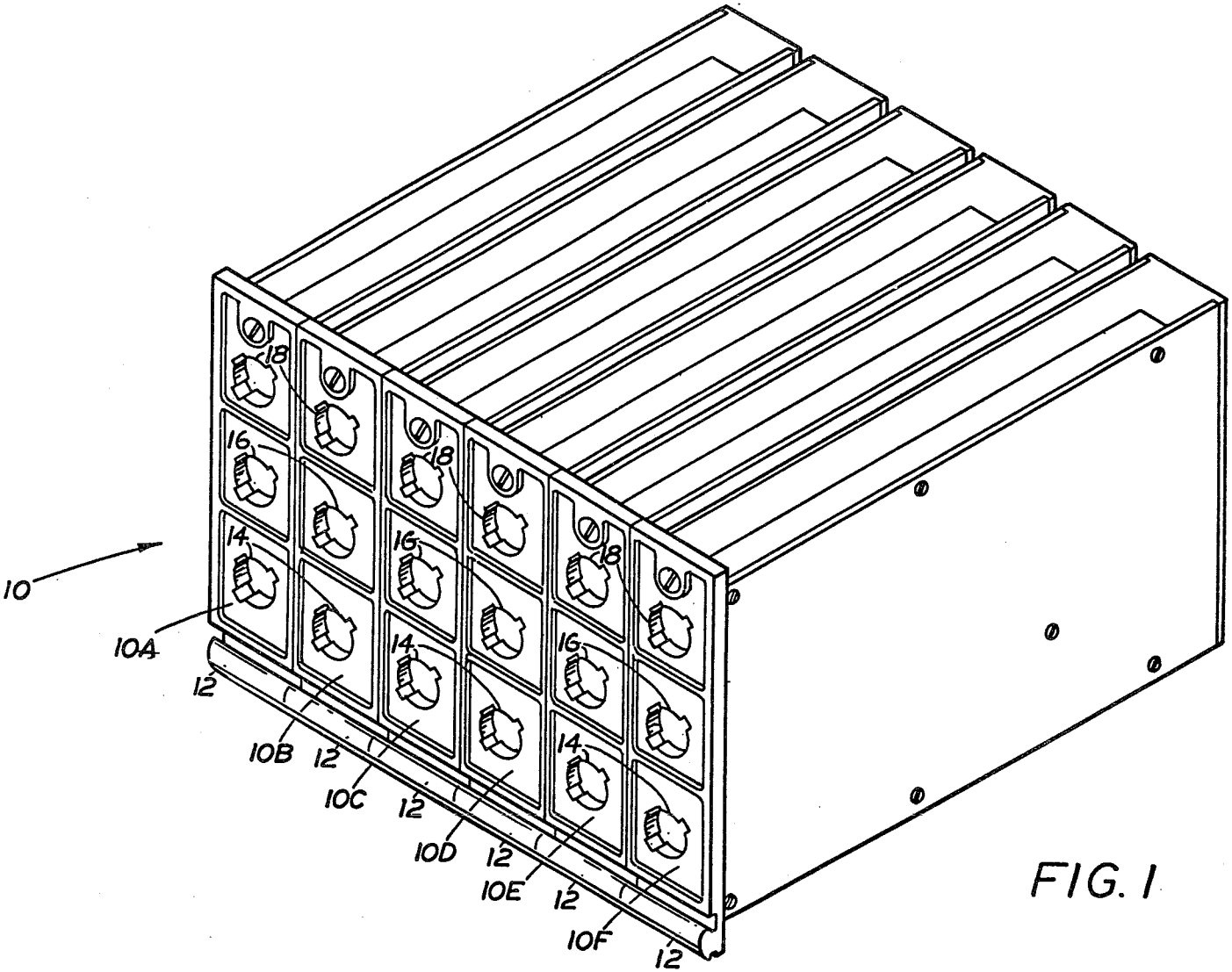
FIG. 1 is a perspective view of a modular group of patch module structures in accordance with the present invention without a wand inserted.

Referring to FIG. 1, there is shown a modular assembly of similar patch modules, generally designated 10, and specifically, six modules in a row. It should be understood that more or fewer patch modules can be used in such an assembly or the modules can be used as individual patch units, as desired. In the preferred embodiment shown, individual patch modules are designated respectively, 10*a*, 10*b*, 10*c*, 10*d*, 10*e*, and 10*f*. Each of the modules has three wand support receptacle openings 14, 16, and 18 which extend through the front panel faced edge, as illustrated.

Figure 2:
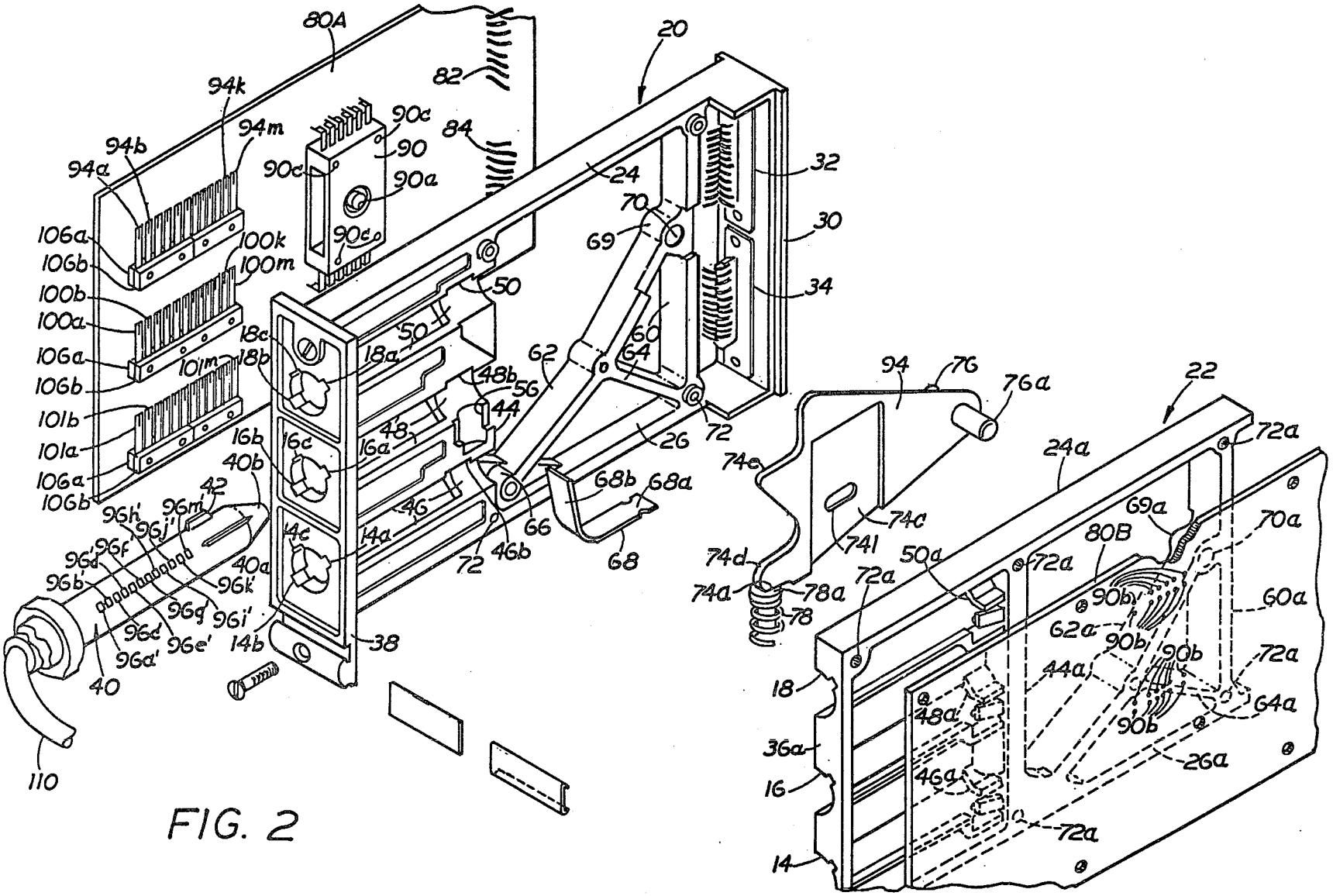
FIG. 2 is an exploded perspective view of a patch module unit and wand showing structural components.

As better seen in FIG. 2, the basic module frame consists of two sub-assembly pieces, a main piece 20 and a mating piece 22, each of which provides essentially half of the width of the frame over most of the length of structure from the front end. In the rear of the frame, however, main piece 20 provides the entire width to facilitate better electrical connector input and output support. Preferably, the two frame pieces are made of molded resinous material, such as phenolic or other moldable resin which hardens into a rigid form. As seen in FIG. 2, when the two frame pieces 20 and 22 are separated from each other, certain cooperating parts fit between the two frame pieces 20 and 22 which provide perimeter edge walls of the switch structure. When mating, frame piece 22 is placed in position and secured to main piece 20, top and bottom walls 24 and 26 of the main piece match and extend the width of the top and bottom walls 24*a* and 26*a* of piece 22. As indicated previously, the rear wall 30 of the frame is provided entirely on main frame piece 20 to better support electrical connectors 32 and 34 which mate with conductors to outside circuitry for electrical input and output, respectively. Front wall 36 of main piece 20 cannot be seen but corresponds in thickness and completes front wall portion 36*a* of piece 22 to complete the frame. A front face panel piece 38 is superimposed over frontwalls 36 and 36*a* and together these walls and panel piece define the guide holes or openings 14, 16, and 18 of jack receptacles, previously identified in FIG. 1.

As shown in FIG. 2, at each end of the patch cable is a wand, generally designated 40, and shown aligned for a proper insertion into a support receptacle guide hole 16. A key, 42 along an element of wand 40 fits into key slot 16*c* (or 14*c* or 18*c*). Slots 16*a* and 16*b* of the hole 16 (or slots 14*a* and 14*b* of hole 14 or slots 18*a* and 18*b* of hole 18) permit passage of the rows of contacts on opposite sides of the wand. Placing the key 42 in the larger key slot 16*c* (the only one large enough to receive it) properly positions the wand 40 for insertion into a support receptacle, and prevents putting the wand into a patch module support receptacle in improper orientation.

Subdividing the frame along its length is a column 44 which has a number of functional features. This column 44 supports the skeleton-like separate support jack receptacles defining the wand paths and providing a keyway to keep key 42 and wand 40 in predetermined orientation until it is fully inserted into the support receptacle. These receptacle defining portions 46 and 46*a*, 48 and 48*a*, 50 and 50*a*, on the separate frame pieces 20 and 22 together define precisely with limited structure the cylindrical receptacles and a keyway for key 42. The keyway is terminated in a circumferential channel 46*b*, 48*b*, and 50*b* extending part way around the cylindrical form. Channels 46*b*, 48*b* and 50*b* extend sufficiently far around the circumference of the receptacle that sufficient rotation necessary to engage the wand contacts can take place when the wand is fully inserted. In such position when the key 42 reaches the circumferential channels 46*b*, 48*b*, or 50*b*, it may be rotated until it reaches a stop at the end of the channel after rotating 45° where it comes to rest against the stop preventing further rotation past the point of contact engagement. Also, as wand 40 is rotated in support receptacle 16, a detent groove 40*a* engages detent 43*a* on displaced molded resilient arm 43 which snaps into the groove 40*a* to index the wand in preferred operative position. Similar detents 41*a* and 45*a* on similar molded resilient arms 41 and 45 in jack receptacles 18 and 14, respectively, serve a similar function in their respective receptacles. In any circumferential channel 46*a*, 48*b*, or 50*b*, the forward channel side wall provides a stop against which the end of key 42 is urged by spring pressure, as will be described hereafter, to axially index the position of wand 40 with its contacts engaged in the selected receptacle.

The same column 44 includes a helical spring retaining cup 56 whose use will be described hereafter.

Spaced from column 44 toward the back of the frame is another column divider 60 on frame piece 20, which together with its counterpart 60*a* on frame portion 22, defines a separate compartment for the plug connectors 32 and 34. The electrical connections into and out of the module are made therefrom through connector 32 and 34.

Strengthening the frame pieces 20 and 22 are diagonal crossbars 62 and 62*a* and diagonal bracing struts 64 and 64*a*. Diagonal crossbars 62 and 62*a* are, respectively, connected at one end to the columns 60 and 60*a* and at the other end to bottom frame members 26 and 26*a*. The connection to the bottom frame members is interrupted by a spring receiving slot at the edges of the frame that fit together and the unconnected end 66 and 66*a* rounded to provide a better bearing surface for L-shaped spring 68. Bottom leg 68*a* of the spring is supported atop bottom frame walls 26 and 26*a* and upright free leg 68*b* partially closes the inside end of jack receptacle 46. The opposite end of crossbars 62 and 62*a*, where it is attached to column 60 and 60*a* is enlarged in massive portion 69 and 69*a*, which provides a bearing support region, through which aligned pin receiving bores 70 and 70*a* extend. Six aligned fastener holes 72 and 72*a* on the respective frame members 20 and 22 provide fasteners access through the frame pieces to hold them together. In addition to alignment afforded by fasteners, frame piece 22 is provided with wells on the inside of the frame piece 22 around holes 72*a* which receive precision bosses on the inside of frame piece 20 surrounding fastener holes 72 which add further accuracy to the alignment process. These members precisely align the six fastener holes and when the fasteners are installed, connect the pieces 20 and 22 together in such a way that they function mechanical by in almost every respect as one piece.

Before assembling the frame pieces together, an actuator lever 74 is assembled in place with its pivot pin portions 76 and 76*a* extending into bores 70 and 70*a*, respectively, as the frame pieces are put together, thus, providing a pivot point at pin portions 76 and 76*a* around which lever 74 rotates. It will be understood that in the region where lever movement occurs, the inside pieces of the frame which would otherwise interfere with rotation are recessed to receive and guide lever 74. Also, before assembly, a helical compression spring 78, together with lever contacting plunger insert element 78*a*, is placed in a receptacle cup 56 and the corresponding portions on frame piece 22.

Figure 3:
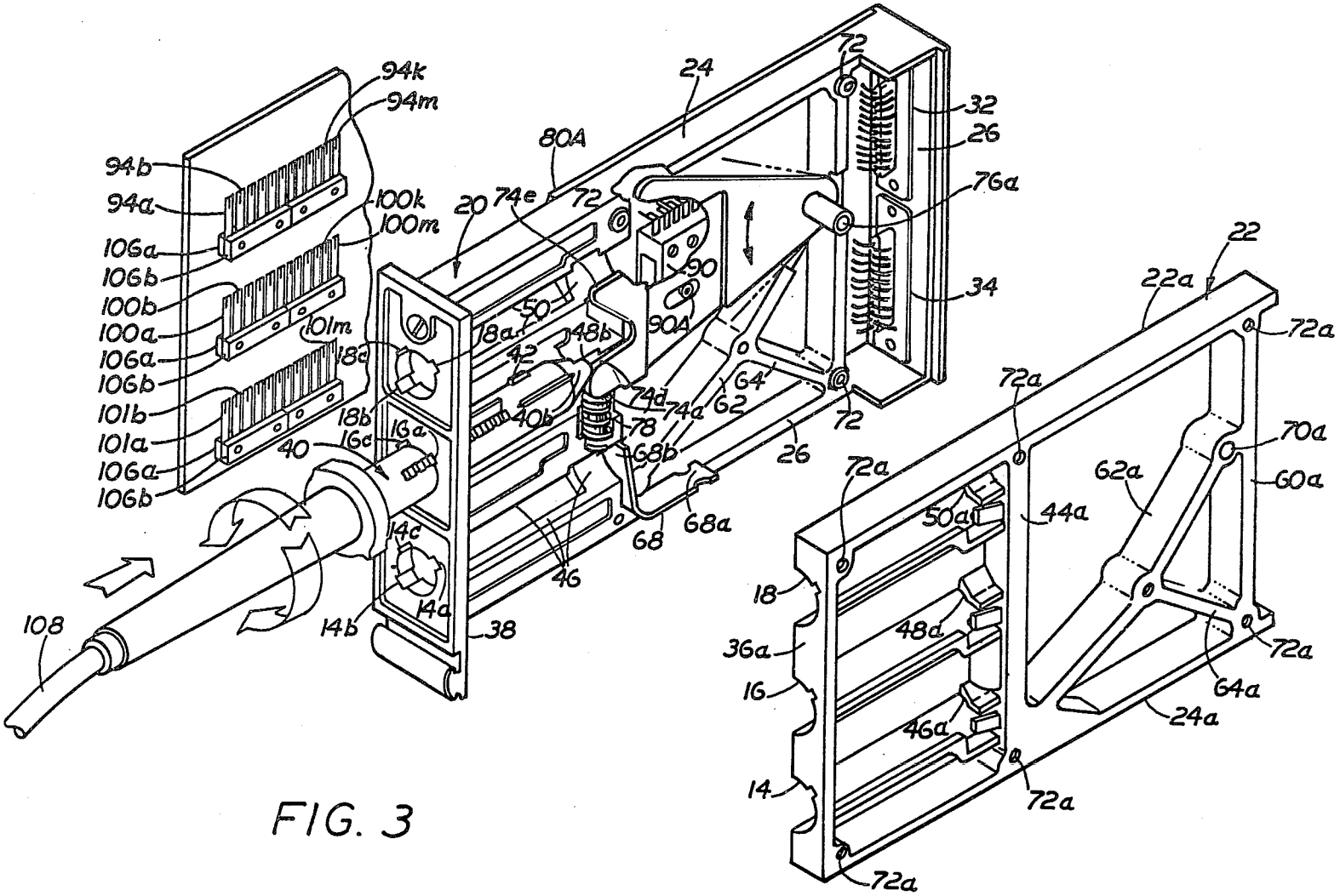
FIG. 3 is a view similar to FIG. 2 but showing part of the structure assembled and the wand in the process of being inserted in a jack receptacle.

Spring 78 retained in cup 56 bears against spring contact area 74*a* of lever 74. As better seen in FIG. 3, the lever 74 is urged upwardly by spring 78 until it engages the top wall as a result of the pressure of the frame members 24–24*a*. In this upper rest position of lever 74, as shown in FIG. 2, a slot 74*b* through the rectangular thinned down area 74*c* of lever 74 will be positioned to receive the respective opposed actuator buttons from the switch packages on each side of the lever, which will be described hereafter. Also as seen in FIG. 3 insertion of the wand 40 sufficiently far into wand receptacle 16 will cause the conical wand nose 40*b* to engage the cam surface 74*d* as shown. Similarly, if the wand 40 is inserted in receptacle 18, it will engage and act on the cam surface 74*e*. No matter which cam surface is engaged, however, the switch actuator lever 74 will be driven downwardly in opposition to spring 78 with the result that the associated switches will be actuated as will be hereafter described.

Insertion of wand 40 into wand receptacle 14 will not result in engagement of a cam surface on the switch actuator lever 74. The end of wand 40 will engage leg 68*b* of spring 68, however, which provides spring pressure urging wand 40 out of receptacle 14. Spring surface 68*b* opposes the nose 40*b* of the wand 40 as it is inserted in support receptacle 14 to give the same feel to the operator as experienced when inserting wand 40 into receptacles 16 or 18. Spring 68 also provides a spring force in opposition to the wand's insertion so that the wand will be positively held in place as previously described, in a manner to be described.

In the preferred embodiments of the present invention, the frame members are closed by sidewalls 80A and 80B which are mirror images of one another. The inside surfaces of walls 80A and 80B are preferably printed circuit boards and may be, for example, constructed of laminated fiberglass or other base materials used for printed circuit boards. While the sidewalls 80A and 80B are thin lightweight structures they must be made sufficiently thick and have sufficient rigidity to have supporting ability, particularly since in preferred embodiments they also function to support switch modules 90 and other switch elements which require some mechanical force for activation. What is said about printed circuit board 80A will be understood to apply equally to printed circuit board 80B without separate description.

In the arrangement shown, input to the patch module is made through connector 32 supported in the backwall 30 of frame 20. Connector 32 is connected to input leads from a mating connector movably attachable to the outside of frame wall 30. Connector 32, for example, provides some 24 separate circuit input connectors in parallel vertical columns of 12 each, and these connectors are preferably connected by right angle contact terminations to the printed conductors of various printed circuit board circuits so that, for example, there are 12 separate circuits on each printed circuit board. Similar output connector 34 is connected in a similar manner between a mating connector on the outside wall 30 from the individual printed conductor on the printed circuit board 80A. A column of holes 82, 84, is provided in the printed circuit boards for connection preferably by soldering of the contact terminals to printed circuit conductors.

Since the circuits are shown schematically in FIG. 5, illustration of the printed circuit has been omitted from the drawings of FIGS. 2 and 3 to avoid confusion, but it will be understood that the printed circuit conductors are provided on boards 80A and 80B to make the necessary connections as shown in FIG. 6. In FIG. 5, the terminations on the board at flexible connector holes 82 and 84 are represented by the dashed lines surrounding the ends of the conductors and mark 82 and 84. In FIG. 5, input conductors from connector 82 are 86*a*, 86*b*, 86*c*, 86*d*, 86*e*, 86*f*, 86*g*, 86*h*, 86*i*, 86*j*, 86*k* and 86*m* and the output conductors to connector 84 are 88*a*, 88*b*, 88*c*, 88*d*, 88*e*, 88*f*, 88*g*, 88*h*, 88*i*, 88*j*, 88*k*, and 88*m*. A flatpack T-Bar® switch module 90 of the type shown in U.S. Pat. No. 3,233,541 assigned to T-Bar® is used. This switch module 90 is composed of 12 normally closed, single pole, commonly actuated switches. As will be seen from the reference patent, each module preferably has 12 sets of opposed contacts supported on resilient blades in two generally parallel planes, six blades extending inwardly from support at one end and six extending inwardly from support at the other end. The free ends of the coplanar blades for one set of contacts extend into opposed grooves along opposite edges of a bar. An actuator normal to the bar, in this case rounded pushbutton 90, moves the blades in unison. The supported ends of the switch blades are brought out the opposite ends of the module in six pairs of terminals. In this case, the terminals are at right angles and narrowed at their ends to present effectively parallel rows of pins received in holes 90*b* through the printed circuit board 80A and 80B but best seen in board 80B in FIG. 2. These pins when inserted can readily be soldered to individual printed circuit conductors through which the holes extend. Separate fasteners 90*c* are also preferably used to attach the switch module 90 securely to the board.

In FIG. 6 the individual switches 90*a* through 90*m* (skipping "l") are schematically shown as series switches connecting lines 86*a* through 86*m* to lines 88*a* through 88*m*, respectively. In preferred embodiments, such as the one shown, these switches are normally closed. All switches 90*a* through 90*m* are opened at the same time by common actuator pushbutton 90*a*. As best shown in FIG. 5, each of the circuit conductors 86*a* through 86*m* is also connected to a conductor 92*a* through 92*m* which terminate in contacts 94*a* through 94*m*. As better seen in FIG. 2 contacts 94*a* through 94*m* cantilever spring contacts. The spring contacts 94*a* through 94*m*, in turn, mate with the contacts 96*a* through 96*m* on the wand 40 when the wand moves these contacts 96*a* through 96*m* into position as will be described hereafter in connection with FIGS. 4*a* and 4*b*. Contacts 96*a* through 96*m* are, in turn, connected to wand leads 98*a* through 98*m*. Connection described thus far assumes that the wand is inserted into support receptacle 18.

If, instead of receptacle 18, the wand is inserted into receptacle 16, wand contacts 96*a* through 96*m* (connected to conductors 98*a* through 98*m*) will be connected instead with spring fingers 100*a* through 100*m* terminating printed circuit connectors 102*a* through 102*m* which, in turn, are connected to printed circuit output connectors 88*a* through 88*m*, as shown in FIG. 5, on the opposite side of switches 90*a* through 90*m* from conductors 86*a* through 86*m*. Still another possibility exists. Another set of conductors 103*a* through 103*m*, also connected to conductors 88*a* through 88*m* either through the conductors 102*a* through 102*m*, or directly. These conductors 102*a* through 102*m*, in turn, may be connected through wand contacts 96*a* through 96*m*, if the wand is inserted into wand receptacle 14.

Returning to a consideration of the mechanical arrangement as seen in FIG. 2, the spring fingers 94*a* through 94*m*, 100*a* through 100*m*, and 100*a'* through 100*m'* are each supported in groups of 6 by and between strips 106*a* and 106*b* which perform an insulator function to electrically isolate the spring fingers from one another and at the same time to support them mechanically spaced away from the printed circuit board to which they are fixed by suitable rivets or other means securing them mechanically rigidly in place so that the spring fingers themselves can move relative to their support but that the supports will not move as a result of pressure on the spring fingers. The ends of the spring fingers are also preferably bent like the ends of the conductors of the switch wafer 90, and narrowed to pins so that they may be inserted into holes 107 (see printed circuit board 80B) and soldered to the printed circuit board. It will be understood that in this respect printed circuit board 80B is not quite a mirror image of printed circuit board 80A since the holes 107 are above the supports 106*a* and 106*b* instead of below them as on board 80A.

It will be observed that when the structures are assembled, the printed circuit boards are held to the frame members by the same means which hold the frame members together. Preferred fasteners are 6 semitubular rivets 108 through the frame. A seventh semitubular rivet of the same form may pass through the junction of the cross-brace 62, 62*a* and bracing strut 64, 64*a* to give the structure extra strength in the region of the lever 72 and its mechanical action.

Referring now to the wand 40 in FIGS. 2 and 3. It will be seen that the structure as viewed in FIG. 2 provides contacts 96*a'* through 96*m'* to cooperate with the spring fingers. The contacts visible in FIG. 2 cooperate with the spring fingers supported on the printed circuit board (80B). It will be understood that there is another circuit for the printed circuit 80B which corresponds to FIG. 5 which is the circuit diagram for the printed circuit board 80A. Wand contacts cooperating with board 80B are those designated 96*a'* through 96*m'*. It will also be understood that on the diametrically opposite side of the wand 40 are a set of contacts 96*a* through 96*m* which cooperate with the different sets of spring fingers on printed circuit board 80A. Specifically, of course, wand contacts 96*a* through 96*m* cooperate with spring fingers 94*a* through 94*m* if inserted into the jack receptacle 18; they cooperate with spring fingers 100*a* through 100*m* if inserted into jack receptacle 16; and they cooperate with spring fingers 100*a'* through 100*m'* if inserted into jack receptacle 14. Each of these wand contacts is connected to a separate individual conductor in the form of an insulated wire. The various wires are gathered together into a cable 110. The cable may, in turn, be connected to another similar wand at its opposite end, preferably with the insulated conductors being connected to corresponding contacts.

In operation, the wand is inserted into one of the support receptacles. For example, it might be inserted into receptacle 16 and must be directed in the orientation shown in FIG. 2. Being so directed, the key 42 and the alignment vanes 40*a* and 40*b* will be aligned with the slots 16*c*, 16*a*, and 16*b*, respectively, the only orientation in which the wand 40 will fit into the receptacle 16. FIG. 3 shows the wand after it has entered receptacle 16, but before it is fully inserted, and just as its conical nose 40*b* makes contact with cam surface 74*d*. The wand acts against the force of spring 78 as it is pressed further into the receptacle and urges the lever 74 downwardly against the pressure of spring 78, which is retained in cup 44. The actuator lever pivoting about its aligned pivot pins 76 and 76*a* moves between the dashed line positions shown. As the lever moves downwardly, as shown in FIG. 3, the lever actuator 90*a* portion moves between the switch wafers 90 on opposite sides, supported by their respective printed circuit boards 80A and 80B. As this occurs, plungers 90*a* of both of the switch modules 90 are depressed causing the normally closed switches to open. As seen in FIG. 5 this action causes the normally closed series switches 90*a* through 90*m* in the path from conductors 86*a* to 86*m* to 88*a* through 88*m*, respectively, to open. This occurs as the wand 40 is being inserted. However, the wand cannot be connected to spring finger contacts 100*a* through 100*m* until this has been completely done. When the wand is fully inserted, so that the wand key 42 matches with the channel 48*b*, the wand which is in the position shown in FIG. 4*a* can then be rotated about its axis to the position shown in FIG. 4*b*. In the course of such rotation, the contacts 96*a* through 96*m* and 96*a'* through 96*m'* are rubbed against the bifurcated spring fingers of the contacts 100*a* through 100*m* and 100*a'* through 100*m'* and into final position shown in FIG. 4*b*. In this position, the wand is urged by spring 78 through cam surface 74*d* but cannot move back toward the opening because it rests in the channel 48*b*. Thus, spring pressure holds the wand in the proper registration with the end of the key against the channel wall so that the contacts 96*a* through 96*m* and 96*a'* through 96*m'* are properly positioned opposite their respective spring fingers, with which they are intended to mate. In support receptacle 16, the contact of wand nose 40*d* against the cam surface 74*d* causes the lever 74 to move downwardly, but the compressed spring 78 continually urges the lever into its upward position which it is restrained from reaching by the nose 40*b* of the wand 40. As observed above the wand is held in its position by key 42 which is held against the sidewall of the channel 48*b*.

The same kind of mechanical operation in general, is presented when the wand 40 is moved to the upper position into support receptacle 18. In receptacle 18, wand nose 40*b* contacts the cam surface 74*e*, rather than cam surface 74*d*, but the action on the lever 74 is exactly the same. Also, the return action tending to urge the wand outwardly of receptacle 18 is the same as for receptacle 16. Again, rotation of the wand 40 makes contact between its terminals 42*a* through 42*m* and 42*a'* through 42*m'*, respectively. The spring fingers 94*a* through 94*m* and the corresponding spring fingers of board 80B are precisely the same as shown in FIGS. 4*a* and 4*b*.

When the wand 40 is inserted in the support receptacle 14, however, a somewhat different thing occurs. In such case, the nose 40*b* of the wand 40 is urged against the spring 68, and specifically displaces the arm 68*b*, thereby storing energy in the resilient body 68 tending to urge wand 40 backward out of the receptacle 14, if it is released. However, the wand does not contact with the switch actuator lever 74. Therefore, in this receptacle 14, the switches 90*a* through 90*m*, and 90*a*' through 90*m*' are not actuated. However, the contacts 96*a* through 96*m* and 96*a*' through 96*m*' are connected to spring contacts 101*a* through 101*m* and 101*a*' through 101*m*', respectively, when the wand is rotated as shown in FIG. 4 connecting conductors 103*a* through 103*m* to conductors of the wand so that the voltage of the line, or like information can be monitored. Meantime, spring 68 cannot urge wand 40 out of receptacle 14 because the sidewall of channel 46*b* holds key 42 in place.

Referring to FIG. 6, the structure of the wand 40 is shown in greater detail. Schematically, the cable connection to a similar section wand 40' is also shown to provide a patch connection. It will be understood by those skilled in the art that this patch connection permits connection of the first elements previously connected to the second elements through switches 90*a* through 90*m* and 90*a*' through 90*m*' to be connected to third elements previously connected to fourth elements by similar series switches, while at the same time assuring that the first elements were first disconnected from the second, and the third elements were first disconnected from the fourth. If cross-connection is desired, a similar pair of wands, also interconnected like those shown in FIG. 6, can be employed to connect the fourth elements back to the second. Alternatively, either the fourth elements or the second elements may be reconnected to any other elements or may be left disconnected, as desired.

FIGS. 6A, 6B and 6C also shows a preferred construction of the wand 40, which is of substantial importance in accordance with the present invention. The wand body, shown in quarter section, is generally a hollow tubular device to contain the 24 leads which are solder connected to the 24 contacts 96*a* through 96*m* and 96*a*' through 96*m*'. The wand in this embodiment consists of two molded resinous pieces, mating hollow semi-cylindrical channels which fit together. The nose 40*b* may be solid so a suitable screw 110, or other fastener, may be used to connect the two pieces 40*c* and 40*d* together at the nose. At the other end, a ferrule 112 fits in a snap or friction fit over the two pieces 40*c* and 40*d* to hold them relative to one another. Suitable interfitting ridges or other indexing means may also be used to help secure proper alignment between the two cylindrical halves. The split between the two halves 40*c* and 40*d*, however, is preferably made even in order to facilitate the assembly and connection of the contact assemblies. A shoulder 40*e* to abut the face 38 is provided on the respective pieces in order to limit the distance the wand may be inserted into a support receptacle.

Referring to FIG. 7, it will be seen that the individual contacts are supported upon insulating contact support blocks 114 and 114', which in the view shown are sectioned at the contacts 96*h* and 96*h*'. As seen in this view, the contacts are conductive metal strips which are folded out of sheet metal into U-shaped form with conductor attachment tabs 130, their internal ends extending diagonally away from the supporting legs.

A better view of one of the support blocks 114 is seen in the side elevational views of FIG. 8 and the plan view from above of FIG. 9. FIG. 8 shows the outward projection of the individual contact supports 116, which are of a dimension to permit them to fit through the contact openings of the wand and spaced from one another so that each contact will fit through opening provided. Between each of the upright pin supports 116 is a lateral extending contact separator 118. Both contact supports 116 and 118 are connected to and supported by common web 120 having a semicircular base 122. These individual contact pieces 124 are preferably provided with domed contact surface 124*a*. The terminals are provided with scalloped edges 124*b* to fit over the contact separators 118 to which shape they conform, and the separators thus tend to hold them in place as well to keep them electrically insulated one from the other. In assembly of the wand, the contacts 124 are assembled to the support 116 and the assembly is pressed through the holes provided in channel 40*c* or 40*d*. The individual insulated conductors which in composite make cable 108 are then soldered to the appropriate tabs and laid in the channel. The cable cover is sufficiently removed from the solder connection to the tabs to permit easy connection to the tabs in the separate channels 40*c* and 40*d*. A soldering tab 130 remains for attachment to the end. Once assembled, flat surfaces at the top surface of the dividers 118 bear against flat surfaces on the insides of the pieces 40*c* and 40*d* beside the contact openings so that the contacts are rigidly supported and indexed as to their outward extension. The dimensions are selected such that the semi-cylindrical members 122 bear against one another when the channels 40*c* and 40*d* are assembled together. Each assembly then supports the other in place when assembled together.

The invention has been illustrated in terms of a single preferred embodiment of the present invention.

It will be clear to those skilled in the art that modified frame constructions will be possible and rearrangement of parts within the frame is possible. Moreover, the use of other types of sidewalls other than printed circuit boards is possible. The means of attachment of the parts, the form of actuator, the kind of switch module and the circuits and mode of operation are all subject to variations in other embodiments. A preferred wand construction and preferred jack receptacle structures have been described but could easily be modified. It will, therefore, be clear to those skilled in the art that the aforementioned and many other modifications are possible. All such modifications and variations within the scope of the claims will be understood to be within the scope and spirit of the present invention.

We claim:

1. A wand structure for use in connection with a patch unit receptacle and associated contacts and circuitry comprising, a generally hollow cylindrical structure consisting of mating cylindrical channels such that, when the structure is assembled, contacts extend through the channel walls along opposite aligned positions of said cylindrical structure, contacts are supported on insulating contact support members to extend from within the hollow cylindrical structure through holes in the channel walls, said contact support members providing shoulders abutting the backside of the cylindrical channels and being arranged so that the contact support member bears against the contact support member for the other channel to hold one another in place with the contacts extending through the holes in the assembled channels and beyond with the wand portions assembled together whereby the two contact support members hold the contacts in operating position.

2. The wand structure of claim 1 in which the exposed surfaces of the contacts which engage contacts in the patch unit receptacles are provided with domed areas.

3. The wand structure of claim 2 in which the contacts include terminals to which wires can be preassembled in the channel pieces before the wand is closed whereby wires extend out the external end of the wand when it is completed.

4. The wand structure of claim 3 in which the wand contacts are connected to individual wires which in turn connect them to a second identical wand structure each wire being connected between corresponding contacts of the respective wands.

5. The wand structure of claim 3 in which the portions of the cylindrical structure of the wand are held together by a ring member and a suitable fastener at opposite ends.

6. The wand structure of claim 5 in which the end of the wand opposite the end from which wires extend is provided with a conical nose which acts as a cam to move a switch actuator member.

7. The wand structure of claim 6 in which the wand is provided with a key which is intended to be engaged in a key guiding channel.

* * * * *

UNITED STATES PATENT AND TRADEMARK OFFICE

CERTIFICATE OF CORRECTION

PATENT NO. 4,158,472

DATED : June 19, 1979

INVENTOR(S) : Lewis J. Seiden and Joseph P. Magnano

It is certified that error appears in the above—identified patent and that said Letters Patent is hereby corrected as shown below:

Column 3, line 4, delete "a" (second occurrence);

Column 3, line 5, "wands" should be -- wand --.

Signed and Sealed this

*Twenty-ninth* Day of *April 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,158,472

DATED : June 19, 1979

INVENTOR(S) : Lewis J. Seiden et al.

It is certified that error appears in the above-identified patent and that said Letters Patent is hereby corrected as shown below:

Column 2, line 23, "3,233,541" should be --3,226,508--.

Column 6, line 29, "3,233,541" should be --3,226,508--.

Signed and Sealed this

Seventh Day of October, 1986

[SEAL]

*Attest:*

DONALD J. QUIGG

*Attesting Officer*

*Commissioner of Patents and Trademarks*